US005092621A

United States Patent [19]

Horn

[11] Patent Number: 5,092,621

[45] Date of Patent: Mar. 3, 1992

[54] SKI SAFETY BINDING

[75] Inventor: Hans Horn, Bern, Switzerland

[73] Assignee: Skis Rossignol S.A., Voiron, France

[21] Appl. No.: 483,457

[22] Filed: Feb. 21, 1990

[30] Foreign Application Priority Data

Feb. 27, 1989 [FR] France ..... 89 02515

[51] Int. Cl.[5] ..... A63C 9/081

[52] U.S. Cl. ..... 280/618; 280/626; 280/628; 280/634

[58] Field of Search ..... 280/617, 618, 626, 628, 280/629, 634

[56] References Cited

U.S. PATENT DOCUMENTS

| | | | |
|---|---|---|---|
| 4,165,883 | 8/1979 | Weigl et al. | 280/618 |
| 4,616,843 | 10/1986 | Freisinger et al. | 280/618 |
| 4,647,065 | 3/1987 | Stritzl et al. | 280/618 |
| 4,758,017 | 7/1988 | Stritzl et al. | 280/618 |
| 4,997,199 | 3/1991 | Horn | 280/618 |

FOREIGN PATENT DOCUMENTS

| | | | |
|---|---|---|---|
| 377703 | 4/1985 | Austria . | |
| 3414521 | 10/1984 | Fed. Rep. of Germany | 280/628 |

*Primary Examiner*—Andres Kashnikow
*Assistant Examiner*—Eric Culbreth
*Attorney, Agent, or Firm*—Kane, Dalsimer, Sullivan, Kurucz, Levy, Eisele and Richard

[57] ABSTRACT

Binding having a plate (1) mounted pivotably (3) and stirrup (4) for holding in place the front part of the foot and a heel unit (5) comprising a body (13) mounted pivotably (14) on the plate and provided with an articulated grip (15). The heel unit comprises a return spring (18) acting also on a movable lock (27) holding in place the body (13) aligned on the plate. The binding comprises a return member (33*a*, 10) returning the plate and the heel unit to the initial position after release. The heel unit is unlocked only after the plate has rotated by a given angle.

23 Claims, 8 Drawing Sheets

SKI SAFETY BINDING

FIELD OF THE INVENTION

The subject of the present invention is a safety binding comprising a plate mounted pivotably on the ski about a vertical pivot and carrying, at the front, holding means intended to hold in place the front end of a boot and, at the rear, a heel unit intended to hold in place the heel of the boot, this heel unit comprising a body mounted pivotably on the plate about a vertical pin and having a grip which can move vertically, the binding furthermore comprising elastic means for returning the grip to the closed position, elastic means for holding the plate in its rest position in which its longitudinal axis is aligned with the axis of the ski and means for locking in rotation the heel unit with the plate comprising a lock subjected to the action of a spring.

PRIOR ART

Such a binding is known from the patent AT 377, 703. In this binding, the plate is held in its position aligned on the ski by a rounded finger engaged in the rounded recess of a stop fastened to the ski. The same finger also serves to lock the heel unit on the plate by means of a lock integral with the finger and to hold the grip of the heel unit against the ski. When the plate pivots under the influence of a torsional force, the finger is first pushed backwards compressing its spring, which, for a very small angle of rotation of the plate, initially ensures the return of the plate to the rest position. As soon as this angle of rotation is exceeded, the finger slips out of its stop and its spring slackens. The heel unit is then unlocked and can pivot, freeing the boot. In this release position, the plate remains in its pivoted position and in order to return the binding to its initial position the plate must be replaced by hand in its aligned position, the heel unit must also be returned and the finger pushed backwards, compressing its spring so as to be able to reintroduce it into its stop. Replacing the boot into the binding therefore requires operations which it is sometimes difficult to perform in the snow or on a steep slope. Furthermore, the use of a stop fastened to the ski for simultaneously ensuring the locking of the plate and of the body of the heel unit does not allow a point contact between the spherical end of the finger and its stop to be avoided. Now such a contact rapidly gives rise to wear which completely alters the characteristics of the binding with respect to its release.

The main object of the present invention is to make it easier to replace the boot in the binding and to produce a permanent linear contact between the pieces of the kinematic chain which participate in release, at least in a forward fall.

SUMMARY OF THE INVENTION

The binding according to the invention has the grip articulated on the said body about a horizontal pin and the binding comprises means for returning the plate and the heel unit to the initial position after release, the lock locking the heel unit is linked kinematically to the plate such that the heel unit is unlocked only after the plate has rotated by a given angle and at least some of the energy used for the release remains stored in the spring after freeing from the heel unit.

There is therefore no slackening of the locking spring after release, but on the contrary this spring remains loaded and its force may be used to return the plate and/or the heel unit to its initial position. After release, the binding thus returns to its initial position and the skier can replace his ski without having to perform any operation other than that of lifting the grip of the heel unit when the fall would not have also caused the upward release of the heel unit. Moreover, the articulation of the grip about a horizontal pin on the pivoting body enables a linear contact to be used and preserved between the pieces of the kinematic chain controlling the release in a forward fall, and also under torsion, as will emerge from the dependent claims.

In order to ensure the return of the plate and the heel unit, the means for returning the plate preferably comprise fixed stop means against which the plate permanently bears. The spring of the lock may also be used as a spring for returning the plate and the heel unit.

The dependent claims define various embodiments of the invention having yet more advantages which will become evident in the course of the description of these embodiments.

BRIEF DESCRIPTION OF THE DRAWINGS

The attached drawing shows, by way of example, four embodiments of the invention.

DESCRIPTION OF THE PREFERRED EMBODIMENTS

Figure 1:
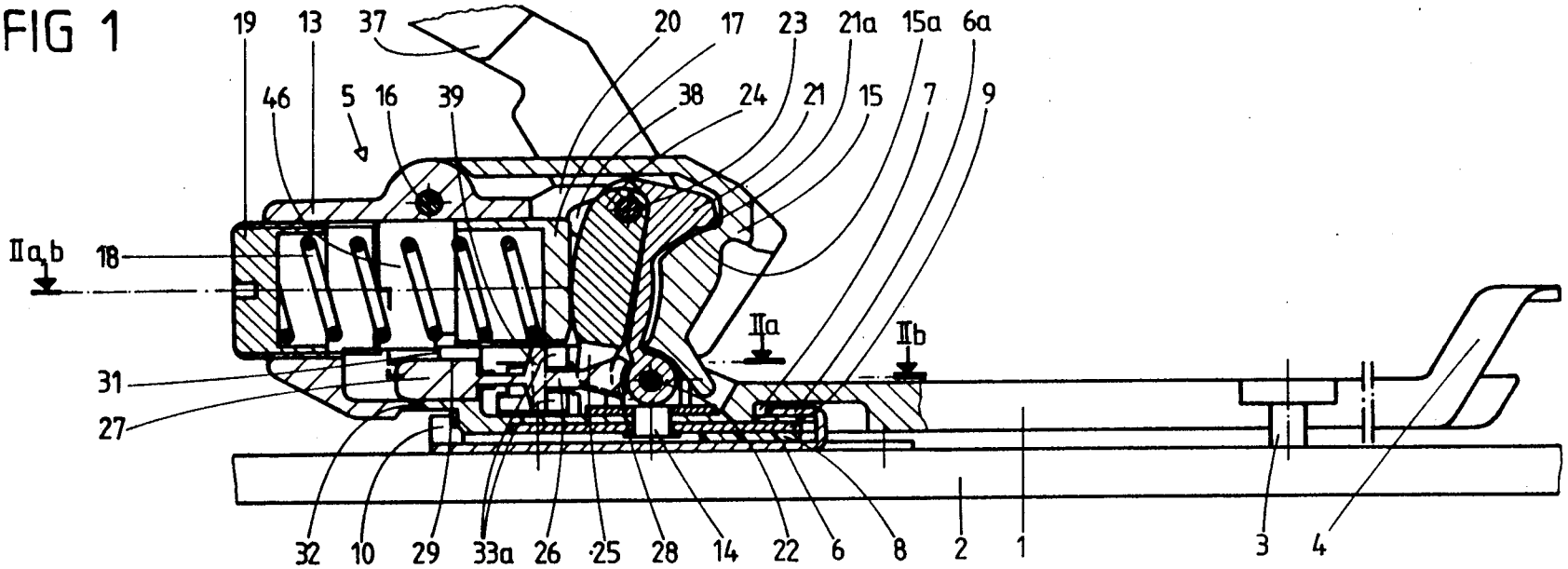
FIG. 1 is a view in longitudinal vertical section, along I-I in FIG. 2, of a binding according to a first embodiment in the closed position.
Figure 2:
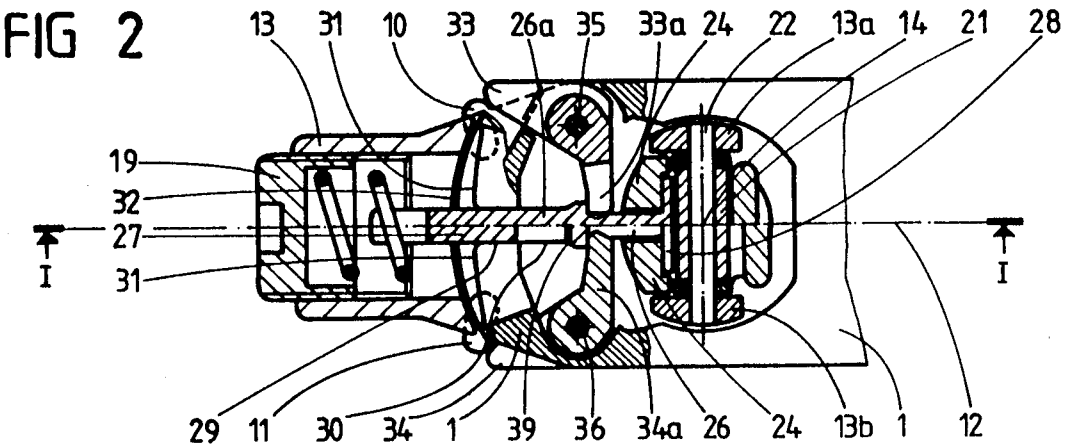
FIG. 2 is a plan view in cross-section along IIa—IIa and IIb—IIb in FIG. 1.

The binding shown in FIGS. 1 and 2 essentially comprises a plate 1 mounted pivotably on a ski 2 by means of a pivot 3, the plate 1 carrying, at the front, a stirrup 4 for holding in place the front end of the boot and, at the rear, a heel unit 5 for holding in place the heel of the boot. The pivot 3 may be made in any known way, for example in one of the ways described in the patent AT 377,703. At the rear, the plate 1 is guided by a plate 6 fastened to the ski 2, a bent-back edge 6*a* of which enters a recess 7 provided in the lower face of the plate 1. The edge 6*a* permits the plate 1 to rotate freely about the pivot 3 but retains the plate in the vertical direction. So as to ensure the free rotation of the plate 1, whilst at the same time preventing dirt from penetrating, the plate 1 is provided with an insert 8 which itself has a low coefficient of friction, fastened to an intermediate plate 9. The plate 6 furthermore carries two stops 10 and 11 arranged symmetrically on either side of the center axis 12 of the binding.

The heel unit 5 comprises a body 13 mounted pivotably on the plate 1, on its center axis 12, by means of a pivot 14. A grip 15 is articulated on the body 13 about a pin 16. The position of the grip 15 shown in FIG. 1 is the position in which it presses the heel of the boot against the plate 1. The body 13 has a horizontal bore 46 in which slides a piston 17 pushed forwards by a spring 18 working in compression and the compression of which may be adjusted by means of a threaded cap 19 screwed into the bore 46. The front part of the body 13 has a vertical gap 20 limited by two cheeks 13*a* and 13*b* of the body 13 (FIG. 2) and in which is mounted a first lever 21 extending approximately vertically and articulated at its lower end about a pin 22 on the body 13. This first lever 21 is provided with a nose 21*a* ending in a rounded rectilinear ridge bearing against an incline 15*a* of the grip 15 under the pressure of the spring 18. A second lever 24, extending downwards and applied against the first lever 21 by the piston 17, is articulated about a pin 23 on the lever 21 near its upper end. The lever 24 bears against the piston 17 by a cylindrical curved surface. At its lower end, the second lever 24 has a vertical central gap 25 in which the horizontal axial rod 26 of a lock 27 is engaged. The front end of the lock rod 26 has a widened part 28 which extends between the split end of the second lever 24 and the first lever 21. The lock 27 is engaged, with a minimum of play, in an axial longitudinal notch 29 provided at the rear end of the plate 1, in a thicker part of the latter. Near the notch 29, the lock rod has a part with a rectangular cross-section 26*a* traversing a passage 30 with the same width provided in the body 13 such that the lock rod is integral in rotation with the body 13. On either side of the notch 29, the rear end of the plate 1 has a vertical cylindrical surface 31 serving as a return incline for the lock 27. The outer ends of this surface 31 are raised in order to form limit-of-travel stops for the lock 27, as will be described later. Above the lock 27, the rear end of the plate 1 has an edge 32 in the arc of a circle centered on the axis of the pivot 14. The body 13 has a similar rounded surface so as to be able to rotate about the plate 1. The plate furthermore carries two levers 33 and 34 pivoted, at a mid-point, about a pin 35 and 36 respectively in the plate 1. These two levers 33 and 34 are identical and mounted identically symmetrically about the axis 12, but they appear different in FIG. 2 because of the different levels of section IIa and IIb shown below and above the axis 12 respectively in FIG. 2. It thus appears that the levers 33 and 34 bear with a single arm, passing below the plate 1, against each of the stops 10 and 11 respectively, whereas they bear with a split arm 33*a* and 34*a* respectively against a bearing surface 39 of the lock rod 26, the arms of the split parts 33*a* and 34*a* passing above and below the lock rod 26 respectively.

In the position shown in FIGS. 1 and 2, in other words the position with the boot on and without any dangerous stress, the spring 18 holds the grip 15 in the folded-down position, as already mentioned above, and it furthermore pulls the lock rod 26 forwards via the second lever 24. By its bearing surface 39, the lock rod presses the levers 33 and 34 against their stops 10 and 11, which causes the plate 1 to be held aligned on the axis of the ski, because of the symmetry of the construction. The binding furthermore has a forked lever 37 articulated on the pin 23, which traverses the cheeks 13*a* and 13*b* through two slots 38 in arcs of a circle centered on the pin 22, and bearing with its lower ends against the grip in a known manner. The lever 37 serves for the opening of the heel unit 5 by hand in a manner known per se.

The release of the binding in a forward fall without exaggerated twisting will be described with reference to FIG. 3. Under the influence of the forward fall, the grip 15 is raised by the heel pushing back the nose 21*a* of the lever 21 which compresses the spring 18, pushing back the piston 17. The binding releases at the moment when the nose 21*a* exceeds the end 22*a* of the incline 15*a* of the grip 15. If this end 22*a* is not exceeded, the grip 15 is returned to its initial position under the pressure of the spring and by the cam effect of the incline 15*a*. It will be noted that in this case the second lever 24 does not intervene and the lock 27 remains stationary The levers 21 and 24 behave as a single lever.

Figure 6:
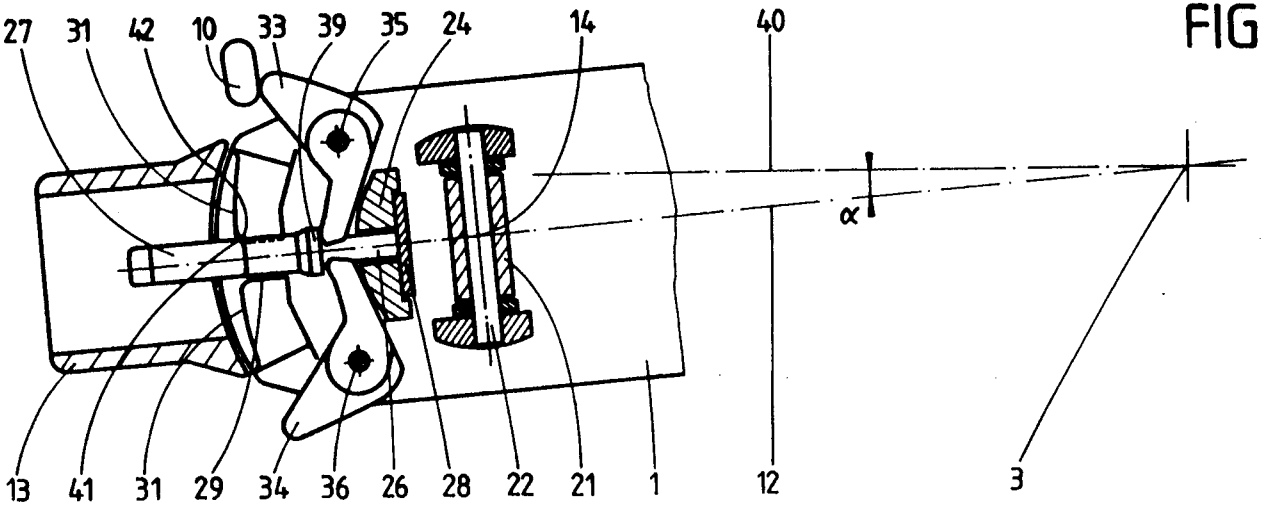
FIG. 6 is a partial plan view of the same binding in the release phase under torsion.

In the case of torsion alone or accompanied by a small forward stress, the plate pivots about its pivot 3, as shown in FIG. 6 where torsion has been shown in an anticlockwise direction by an angle $\alpha$ relative to the axis of the ski 40. In this case, the lever 33 is pushed back by its stop 10 and pushes back the lock rod 26 by its bearing surface 39, compressing the spring 18. As long as the lock 27 is engaged in the notch 29 of the plate, the heel unit 5 cannot rotate on the plate 1. Furthermore, if the torsional stress ceases before the lock has slipped out of the notch 29, the system reverts to its initial state of equilibrium, as shown in FIG. 2, by the influence of the spring 18 which pushes back the lever 33 until the lever 34 bears again against its stop 11. The binding has not released and the skier can continue skiing. This will be the case, for example, with a torsional stress which is high but lasts for a very short time. FIG. 6 shows the critical angle $\alpha$ of torsion without release. This angle is, for example, 5°. In this position, one of the rounded corners 41 of the lock 27 is already against the rounded corner 42 of the notch 29 and the heel unit has already pivoted very slightly on the plate 1. Still in this position, if the torsional stress ceases, the lock reverts to its initial position and the binding does not release.

Figure 7:
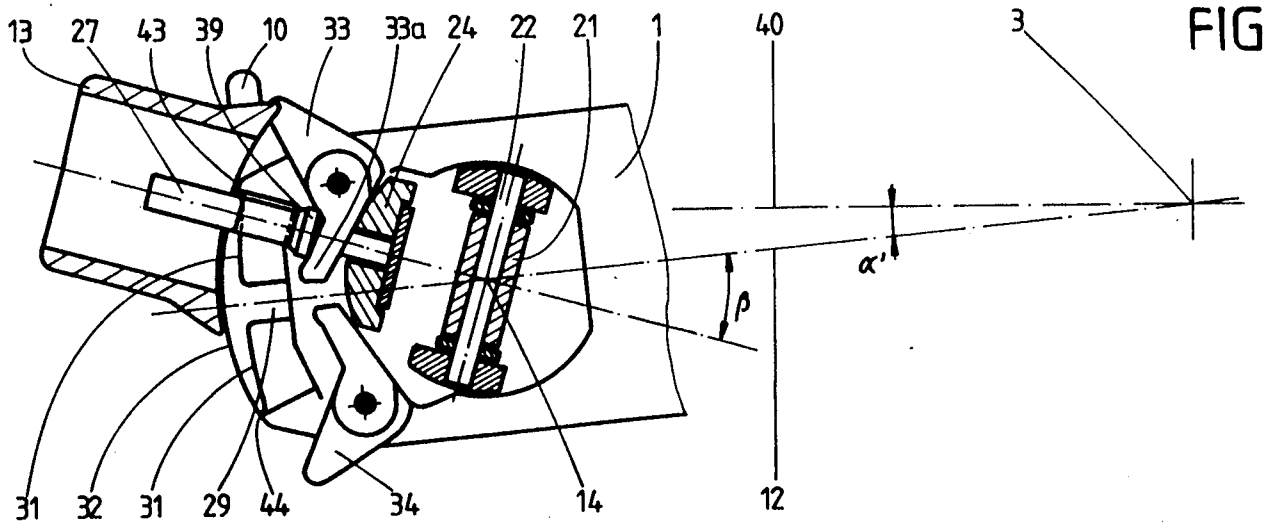
FIG. 7 shows the same binding after release under torsion.

On the other hand, if this angle $\alpha$ is exceeded, the lock 27 slips out of its notch 29 and, under the influence of the lateral pressure of the heel, the heel unit 5 pivots on the plate 1, finally freeing the boot. During this rotation, the lock 27 slides on the incline 31 of the plate 1. Since the curvature of this incline 31 is smaller than the curvature of the outer edge 32 of the plate, the lock 27 continues to be pushed backwards, compressing the spring 18 even more. The travel of the lock 27 on the incline 31 is limited by the raised end 43 of the incline, which corresponds to a maximum angle of rotation $\alpha$ of the heel unit on the plate. This position is shown in FIG. 7. As soon as the boot has left the heel unit, in other words as soon as the torsional stress has ceased, the incline 31, by its cam effect, returns the lock 27 to opposite its notch 29 because of the strong compression of the spring 18. Simultaneously and subsequently, the bearing surface 39 pushes back the lever 33 which, bearing against the stop 10, returns the plate to its initial position aligned on the axis 40 of the ski, as described with reference to FIG. 6. During this release, the first lever 21 does not intervene at all and the second lever 24 is used as a transmission means between the piston 17 and the lock rod 26 which is pushed backwards by the lever 33, as appears more clearly in FIG. 4.

If the friction of the lock 27 on the incline 31 proves to be too high to allow the lock to return to its initial position, it is possible to provide return inclines nearer the vertical axis of pivot axle 14, against which inclines the lock bears with a suitable bearing surface.

The mechanical distinction made between the release function in a forward fall and the release function under torsion, in spite of the use of common elements, in particular a single spring, will be noted. This has been made possible by the use of the double lever 21/24, which construction may also be termed a double-hinged heel unit.

This construction also enables the optimum conditions to be ensured in the event of torsional stress combined with a forward fall, as will be described with the aid of FIG. 5 which shows the heel unit in a diagonal-release phase. The stressing of the grip 15 upwards pushes back the lever 21, as in the case of FIG. 3. Simultaneously, the torsional stress pushes the lock 27 backwards, as described with reference to FIGS. 4, 6 and 7. The piston 17 is pushed backwards by the combined force of the raising of the grip 15 and the torsion on the plate 1.

Figure 1A:
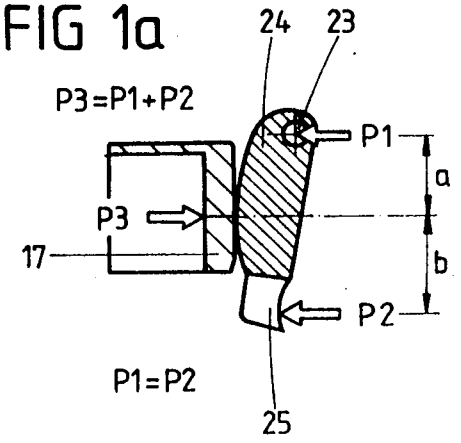
FIG. 1*a* diagrammatically illustrates the relation of the forces in the position of the binding shown in FIG. 1.
Figure 3:
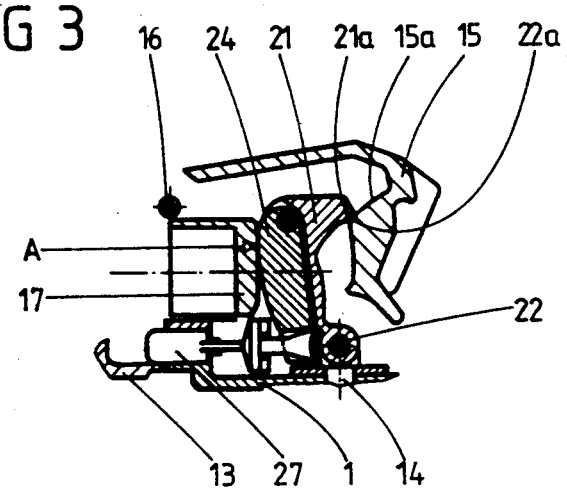
FIG. 3 shows in part the binding in FIG. 1 in the release phase in a forward fall.
Figure 3A:
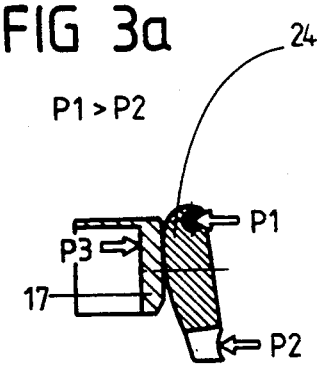
FIG. 3*a* shows the relation of the forces in the position corresponding to FIG. 3.
Figure 4:
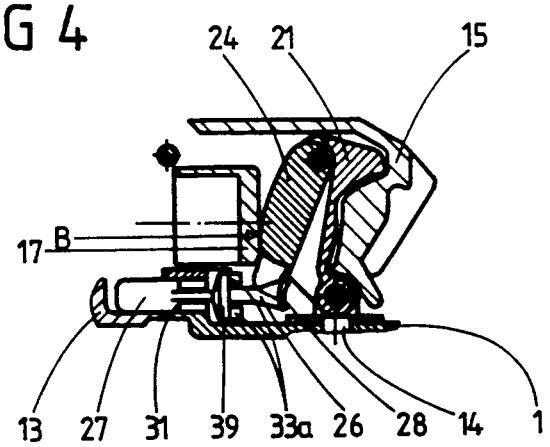
FIG. 4 is a similar view of the same binding in the release phase under torsion alone.
Figure 4A:
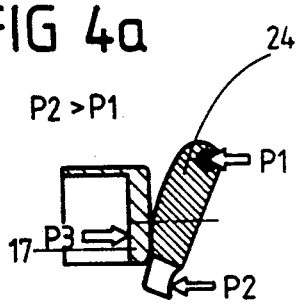
FIG. 4*a* shows the relation of the forces in the position corresponding to FIG. 4.
Figure 5:
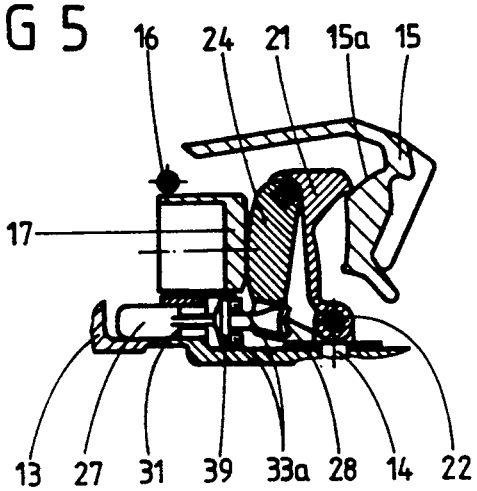
FIG. 5 is a similar view of the same binding in the release phase in a combined forward and twisting fall.

It can be seen that the bearing point of the lever 24 on the piston 17 is not the same in FIGS. 3 and 4, as is clearly evident from these figures. In the case of FIG. 3 (forward fall), the distance between the bearing point A of the lever 24, in other words of the lever 21 since these two levers form one body in the event of a forward fall, against the piston 17 and the pin 22 is greater than the distance between the bearing point B of the lever 24 against the piston 17 and the pin 22 in FIG. 4. There is therefore a variation in the lever arms relative to the bearing point (line) of the piston 17 against the curved lever 24. This variation is particularly favorable, as will be explained with the aid of FIGS. 1*a*, 3*a* and 4*a* which diagrammatically show three states of equilibrium for three characteristic states of the binding. Pl is the force exerted by the grip 15 on the pin 23 of the lever 24. P2 is the force exerted on the end 25 of the lever 24 by the reaction of the stops 10 and 11. P3 is the force exerted by the piston 17 on the lever 24. When the system is in equilibrium, P3=P1+P2. The lever arms of the forces P1 and P2 are designated by a and b.

When the system is in equilibrium, then, relative to the point of application of the force P3

$$\text{TI } P1 \times a = P2 \times b$$

Dividing P2×a, we obtain $$\frac{P1}{P2} = \frac{b}{a}$$

The ratio of the forces P1 and P2 is therefore equal to the inverse ratio of their lever arms. The length of these arms therefore plays a very important role in determining the release forces of the binding. Moreover, it emerges from FIGS. 3*a* and 4*a* that these lever arms a and b vary as a result of the convex shape of the lever 24. By means of this convex shape and the progressive characteristic of the spring, it is possible to obtain a specific behavior during diagonal release, in other words in the event of a forward fall accompanied by twisting.

Diagonal behavior is favorable if the torsional energy required for the release is less than the torsional energy required for release under torsion alone. Now if FIGS. 4 and 5 are compared, it will be noted that this is indeed the case, since the lever arm b is substantially shorter in the position corresponding to FIG. 4 than in the position corresponding to FIG. 5, from which it follows that P2 is substantially greater in the case of FIG. 4.

Conversely, it is appropriate for the energy required for the release in a forward fall to decrease if the leg is simultaneously subjected to a twisting. Now this is indeed the case since the lever arm a of the force P1 is larger in the position corresponding to FIGS. 4 and 4*a* than in the position corresponding to FIGS. 3 and 3*a*, which means that, conversely, P1 is smaller during diagonal release than during release in a simple forward fall. In all cases, the diagonal release does not result from the sum of the forces required for the release in a forward fall and in a twisting fall respectively, but the forces required are on the contrary reduced, which concurs with the teaching relating to the resistance of the leg in the event of superposed flexural and torsional forces.

The reduction of the force P1 when the plate is moved under torsion, (FIGS. 4 and 4*a*) has the further advantage of reducing the pressure of the boot on the ski, and consequently, of the frictional forces, and thus making it easier for the boot to slip out laterally.

It will be noted that, with a relatively very simple construction and the addition of a second lever 24, it has been possible to separate the release functions in a forward fall and under torsion, which has furthermore allowed linear contacts to be maintained, on the one hand between the nose 21*a* of the lever 21 and the incline 15*a* of the grip 15 and, on the other hand, between the piston 17 and the lever 24, the latter during the entire release phase. Now such a linear contact has the advantage over the devices with point contact used up until now of much less wear and a much smaller sensitivity to dirt. The point contact used up until now, whether with a ball or with the spherical cap of a finger, gives rise to the formation of a hollow caused by wear, which hollow completely alters the characteristics of the binding and may make safety impossible even though the sphere has up until now generally been considered as the ideal solution.

In the event of twisting in the opposite direction it is, of course, the stop 11 and the lever 34 which intervene and the lock 27 is displaced on the other part of the incline 31 as far as the stop 44 (FIG. 7).

A second embodiment of the invention will now be described with reference to FIGS. 8 to 11.

So as to lighten the description and to prevent purposeless repetitions, the parts of the binding which are identical to the first embodiment or have undergone only minor modifications are designated by the same references. In this second embodiment, the levers 33 and 34 bear directly on the lower end of the second lever 24 by their ends 33*a* and 34*a*. A piston 45, against which acts a first spring 47, the precompression of which may be adjusted by means of a threaded cap 48, is mounted in the bore 46. The piston 45 has, in its lower part, a projection 49 forming a lock engaged in a catch 50 provided at the rear of the plate 1. On either side of this catch, the rear edge of the plate has the form of a rounded incline 51, an incline similar to the incline 31 in FIG. 2. The frontal face of the piston 45 bearing against the curved face of the lever 24 is not continuous but extends only over the lower half of this frontal surface. The upper part is occupied by a second piston 52 on which acts a second helical spring 53 coaxial with the spring 47 but with a smaller diameter so as to bear only against the piston 52. The precompression of the spring 53 may be adjusted individually by means of a threaded cap 54 screwed into the threaded cap 48. The piston 52 is furthermore integral with a guide rod 55 sliding in a bore 56 provided in the threaded cap 54.

Figure 10:
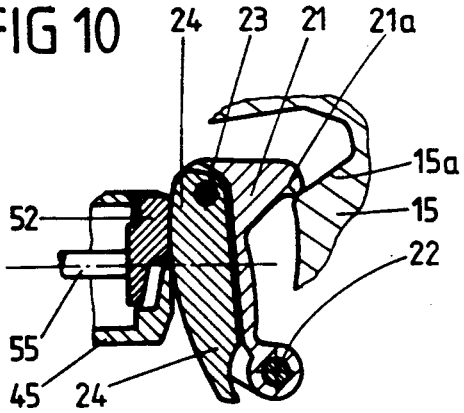
FIG. 10 is a partial view of FIG. 8 in the release phase in a forward fall.
Figure 11:
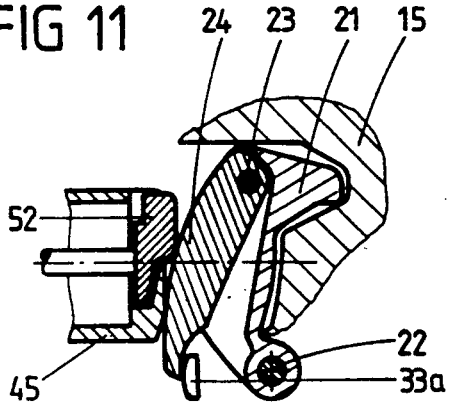
FIG. 11 is a view similar to FIG. 10 in the release phase under torsion alone.
Figure 12:
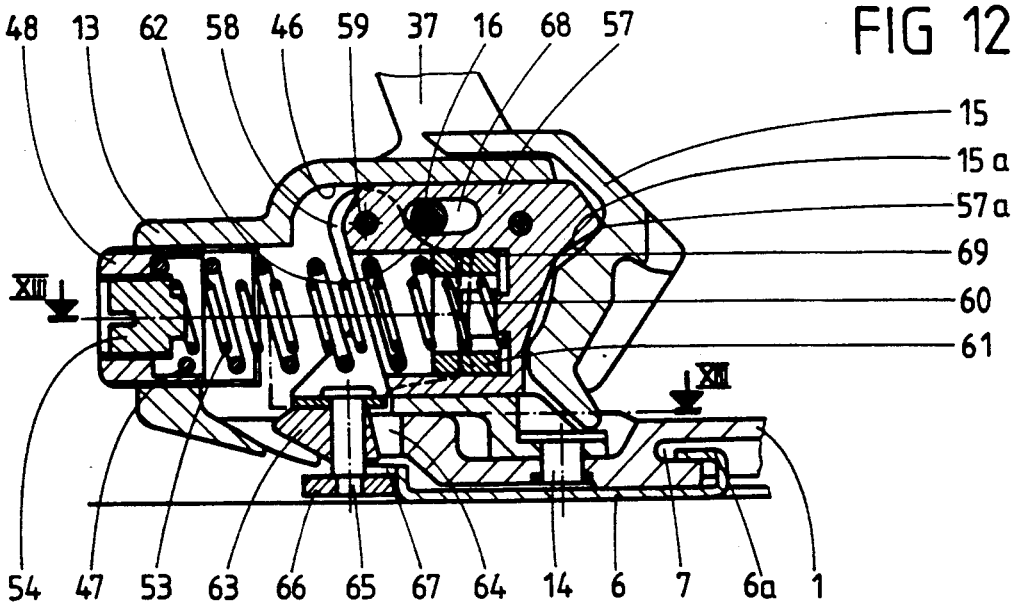
FIG. 12 is a view in longitudinal vertical section along XII—XII in FIG. 13 of the rear part of a binding according to a third embodiment.
Figure 13:
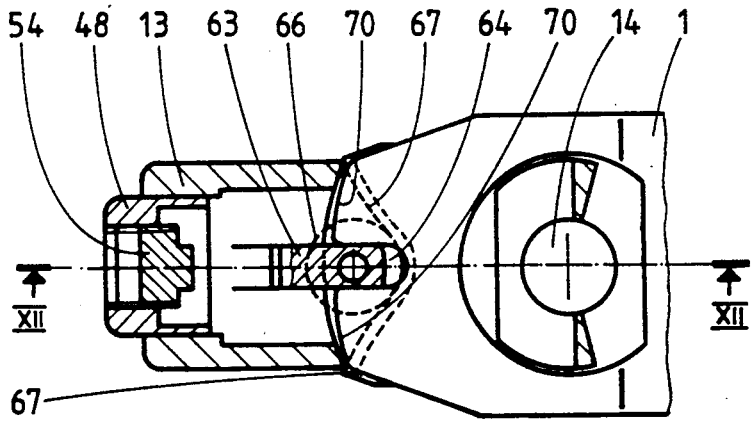
FIG. 13 is a view in cross-section along XIII—XIII in FIG. 12.

Upon a forward fall without any substantial twisting, the grip 15 pushes the first lever 21 back and with it the second lever 24 which simultaneously pushes back the pistons 45 and 52, thus compressing the two springs 47 and 53 (FIG. 10).

On the other hand, when under torsion alone (FIG. 11), one of the levers 33 or 34, for example the lever 33, moves the lower end of the second lever 24 with its arm 33*a*. In its displacement, the lever 24 mainly pushes back the piston 45 and only slightly the piston 52, with the result that it is the outer spring 47 which is mainly compressed. It is therefore possible to adjust differently the elastic resistance to release in a forward and in a twisting fall. Considering FIG. 10, it will be noted that, in the event of diagonal release, the lever 24 moves away from the lever 21 and pushes back the piston 45 at a point closer to the pin 22, which makes it easier for the grip 15 to slip out.

As in the first embodiment, the rotation of the plate 1 beyond a certain angle causes the lock 49 to leave its housing 50, which permits the heel unit to rotate on the plate 1. The lock 49 then comes up against one of the parts of the incline 51. The rotation of the heel unit may be limited by any stop means, for example by stops provided at the outer ends of the incline 51, as in the first embodiment. As soon as the stress ceases, the force stored by the springs 47 and 53 and the cam effect of the incline 51 return the lock 49 to its housing 50, whereas one or other of the stops 10 and 11 and the corresponding lever return the plate 1 into alignment with the ski.

A third embodiment of the binding according to the invention will now be described with reference to FIGS. 12, 13, 14 and 15. For the sake of simplification and in order to avoid repetitions, the parts of this binding similar to those in the first or second embodiment are designated by the same references, even if these parts have undergone some modification in shape. Thus a body 13 is again to be found, mounted pivotably on the plate 1 by means of a pivot 14 and having a bore 46 in which two coaxial springs 47 and 53 are mounted, the precompression of which may be adjusted separately by means of two threaded caps 48 and 54, as in the second embodiment. In this case, the hinge pin 16 of the grip 15 traverses the bore 46. The first lever 21 is here replaced by a slide 57 sliding in the bore 46 and bearing by the rounded rectilinear ridge 57*a* of a front nose against the incline 15*a* of the grip 15 under the pressure of the inner spring 53. A lever 58 corresponding to the second lever 24 of the previous embodiments is articulated about a pin 59 at the rear of the slide 57 in its upper part. This lever has at the front two transverse flanges 60 which are slightly curved and against which bears a piston 61 sliding in a bore 62 of the slide 57 and on which acts the outer spring 47. This spring 47 therefore acts on the lever 58. The lower end of the lever 58 carries a lock 63 engaged in an axial catch 64 provided at the rear of the plate 1. This same lower end of the lever 58 carries a vertical pin 65 on which is rotatably mounted a roller 66 bearing, under the influence of the spring 47, against the base of an incline 67 in the shape of a very open V reminiscent of a sine wave, formed by the raised rear edge of the plate 6. This incline 67 has a cam function similar to the stops 10 and 11 of the previous embodiments It should further be pointed out that the pin 16 of the grip 15 traverses the slide 57 through a slot 68 so as to enable the displacement of the slide 57, and that a clearance 69 is provided between the front end of the piston 61 and the base of the bore 62 of the slide 57, against which base bears the inner spring 53.

Figure 14:
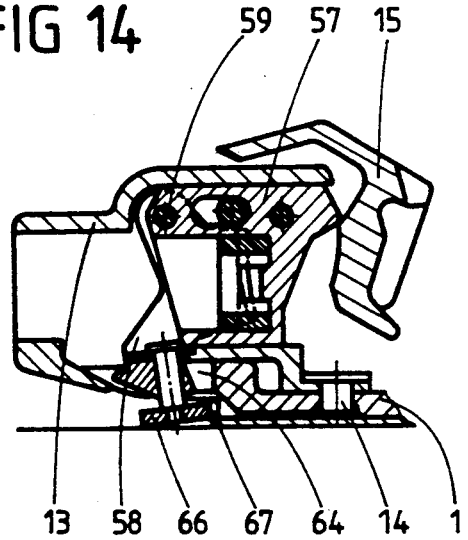
FIG. 14 shows a binding corresponding to FIG. 12 in the release phase in a forward fall.

In the event of a forward fall without twisting, the slide 57 is pushed backwards by the grip 15, compressing the two springs 47 and 53, as shown in FIG. 14. The lever 58 tilts slightly on the incline 67 such that the bearing point of the piston 61 on the flanges 60 is displaced upwards, as in the previous embodiments.

Figure 15:
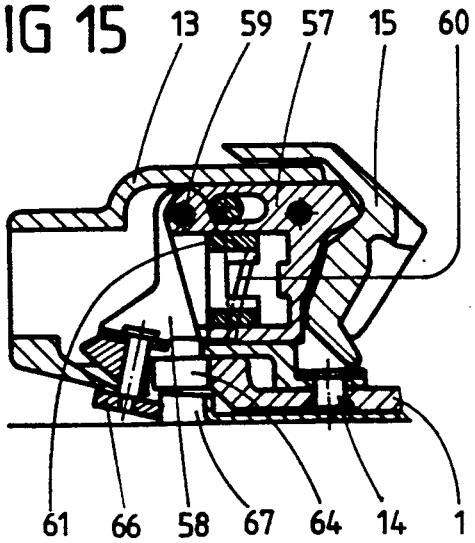
FIG. 15 shows the same binding in the release phase under torsion.

When a high torsional stress is exerted on the plate, the roller 66 is displaced on the incline 67 to one or other side of the position shown in FIG. 3, which causes the lever 58 and the piston 61, which compresses the spring 47 as shown in FIG. 15, to move. The bearing point of the piston 61 against the curved flanges 60 is displaced downwards, as in the previous embodiments. The slide 57 remains stationary and the spring 47 is not compressed. When the angle of rotation of the plate 1 reaches 5°, the lock 63 reaches the edge of the catch 64, a position identical to the position of the lock 27 in FIG. 6. After this angle has been exceeded, the lock 63 slips out of the catch 64 and the heel unit can pivot on the plate 1, freeing the boot. Under the pressure of the boot, the lock is displaced on the incline 70 formed at the end of the plate 1, which incline is similar to the incline 31 in the first embodiment. The displacement of the lock 63 on the incline 70 causes only a slight increase in the compression of the spring 47. As soon as the stress on the heel unit ceases, the lock 63 is returned into the catch 64 and the incline 67 returns the roller 66 into the position shown in FIG. 3. The binding is again in its initial position.

Figure 16:
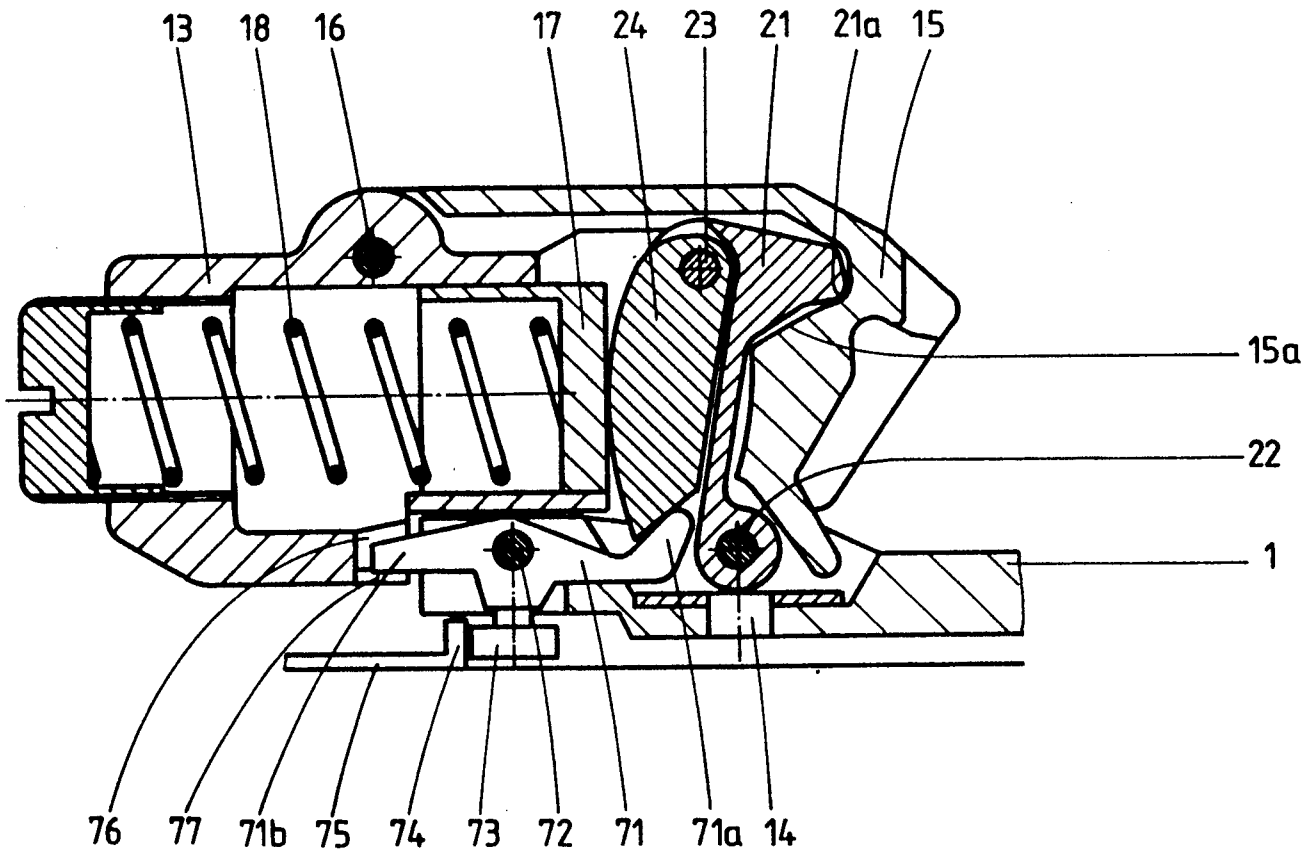
FIG. 16 is a view in longitudinal vertical section through the rear part of a binding according to a fourth embodiment.

A fourth embodiment is shown in FIG. 16. The pieces identical or similar to those in the first embodiment have again been designated by the same references. Virtually the same heel-unit body 13 and the same levers 21 and 24, as well as the same piston 17 and a single spring 18, are to be found again in this embodiment. This fourth embodiment differs from the first embodiment by the means for returning the plate and the heel unit. The plate carries a two-arm lever 71 extending in the longitudinal axis of the plate and pivoted on a transverse horizontal pin 72. This lever 71 carries a roller 73 mounted rotatably on a pin perpendicular to the pin 72. The front arm 71*a* of the lever 71 is pressed downwards by the second lever 24 under the action of the spring 18, which causes the roller 73 to be applied against an incline 74 with the same shape as the incline 67 in FIG. 13, formed on a plate 75 fastened to the ski. The other arm 71*b* of the lever 71 forms the lock of the heel unit and it is, for this purpose, engaged in a catch 76 of the body 13.

Upon the exertion of a torsional stress on the plate 1, the roller 73 is pushed towards the front of the binding by the incline 74, which causes the lever 71 to pivot in an anticlockwise direction, compressing the spring 18. Beyond a certain angle of twisting, the lock 71*b* slips out of the catch 76, which allows the heel unit to pivot on its pivot 14. Once it has slipped out of the catch 76, the lock 71*b* bears against an oblique incline 77 provided on either side of the catch 76 on the body 13. Consequently, as soon as the stress ceases, the incline 77, under the pressure of the spring 18 and via the lever 71, returns the catch 76 to opposite the lock 71*b*. The entire force is then applied on the roller 73 and the incline 74 returns the plate to its initial position.

Figure 17:
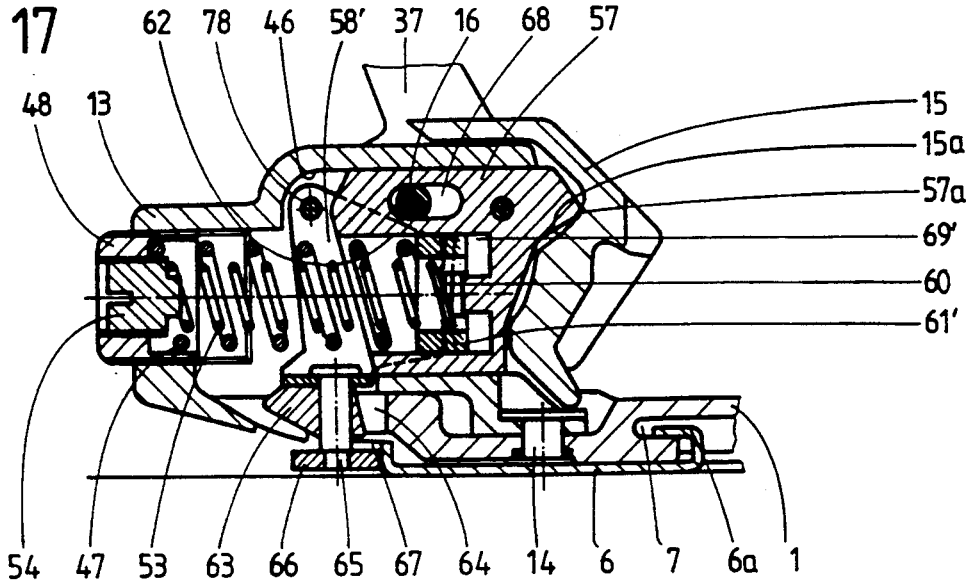
FIG. 17 shows a fifth embodiment derived from the third embodiment.

The kinematic chains for releases in a forward fall and in rotation could be completely independent. An exemplary embodiment is shown in FIG. 17. This embodiment is derived from the embodiment shown in FIG. 12 and we will consequently limit ourselves to describing how FIG. 17 differs from FIG. 12. The lever 58' is no longer articulated on the slide 57, but on the body 13 about a pin 78, to be more precise about two pins, on either side of the body 13. The piston 61' is shorter than the piston 61 and the clearance 61' between this piston and the base of the slide is greater than the clearance 61, such that the slide 57 may move backwards without moving the piston 61'. This embodiment enables the forces required for each of the types of release to be controlled more simply as the springs are stressed by only one type of stress respectively.

Figure 18:
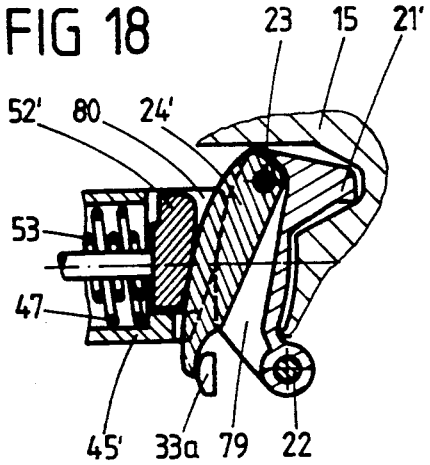
FIG. 18 shows in part a sixth embodiment derived from the second embodiment.

In the case of the first and second embodiments, it is also possible to provide two springs acting on only one of the levers 21 and 24 respectively. Starting from FIG. 8, such an embodiment may be obtained by altering the shape of the levers 21 and 24 and the shape of the pistons 45 and 52. Such a modification is shown in FIG. 18.

The lever 21' has two flanges 79 extending in parallel on either side of the lever 24' and the piston 45' has a split head 80 bearing only against the flanges 79. The piston 52' has a head, the width of which corresponds to the width of the lever 24, against which it bears such that it can bear only against the lever 24'.

Numerous other alternatives are possible.

Figure 19:
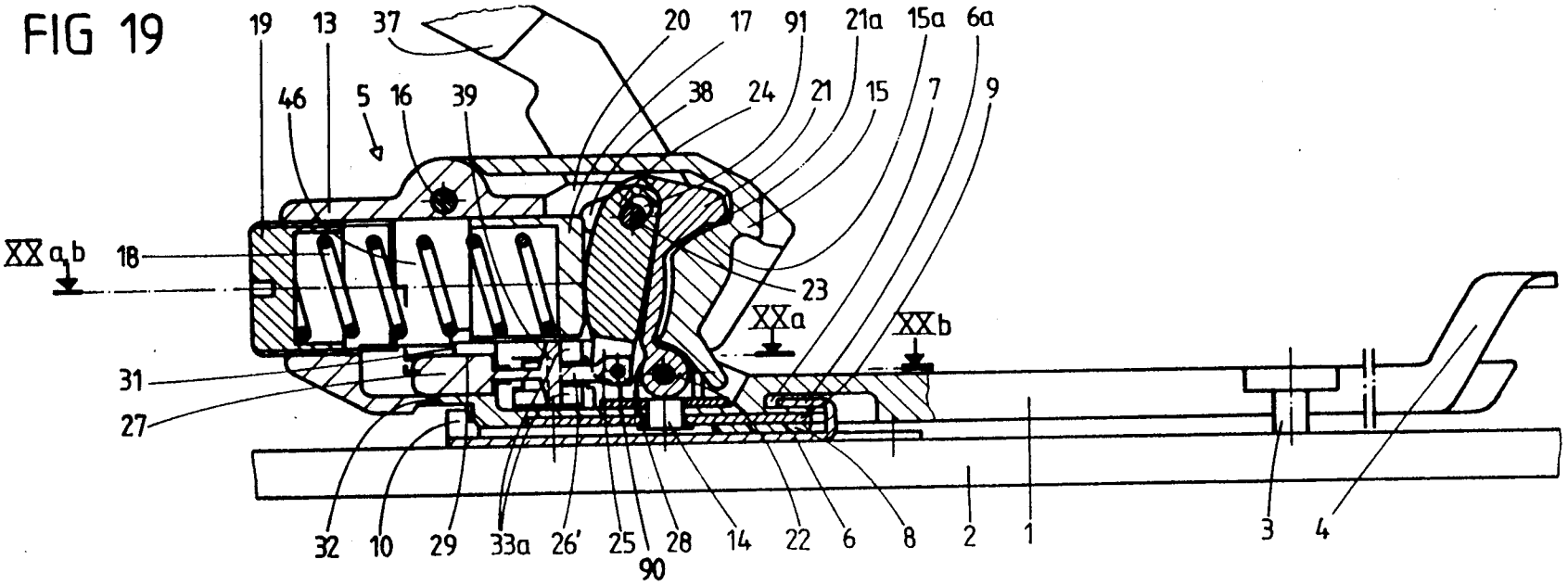
FIG. 19 shows an alternative embodiment of the first embodiment.
Figure 20:
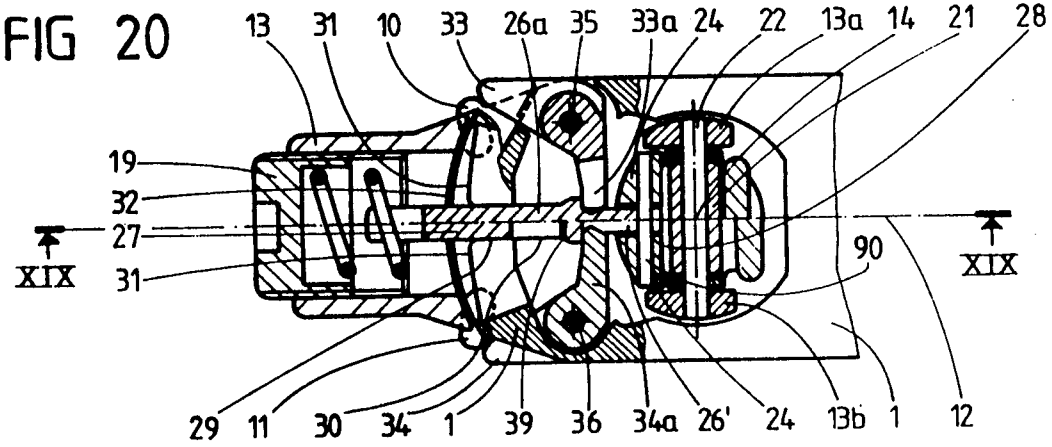
FIG. 20 is a plan view in section along XXa—XXa and XXb—XXb in FIG. 19.

An alternative embodiment of the first embodiment is shown in FIGS. 19 and 20. In this alternative, the axial rod 26, designated by 26', is articulated in the central gap 25 of the lever 24 by means of a pin 90. In order to allow the levers 21 and 24 to work, the pin 23 may be displaced in a slot 91 provided in the lever 24. This alternative allows a space saving to be achieved.

I claim:

1. A ski safety binding comprising a plate (1) mounted pivotally on the ski about a vertical pivot (3) and carrying, at a front, holding means (4) to hold in place the front end of a boot and, at the rear, a heel unit (5) to hold in place the heel of the boot, said heel unit comprising a body mounted pivotally on the plate, about a vertical pin (14) and having a grip (15) movable vertically, elastic means for returning the grip to a closed position, elastic means for holding the plate in a rest position in which a longitudinal axis of the plate is aligned with an axis of the ski, means for locking in rotation the heel unit with the plate comprising a lock (27; 49; 63; 71*b*) subjected to the action of a spring; wherein said grip (15) is articulated on said body (13) about a horizontal pin (16), means for returning the plate and the heel unit to an initial position after release (10, 11, 33, 34, 31; 51; 64, 67, 70; 71, 73, 74, 77), said means for returning said plate comprising fixed stop means (10, 11; 67; 74) fastened to said ski against which the plate bears wherein the lock (27) is engaged in a notch (29) of the plate formed in the center of an incline (31) on which the lock is displaced after having left said notch, and wherein the lock (17; 49; 63; 71*b*) locking the heel unit is linked to the plate such that the heel unit is unlocked only after the plate has rotated by a given angle and wherein the spring (81; 47, 53) is biased when said heel unit is freed by rotation.

2. The binding as claimed in claim 1, wherein the return means for the plate (64, 65, 58', 61', 53) are independent of the return means for the grip (57, 47).

Figure 8:
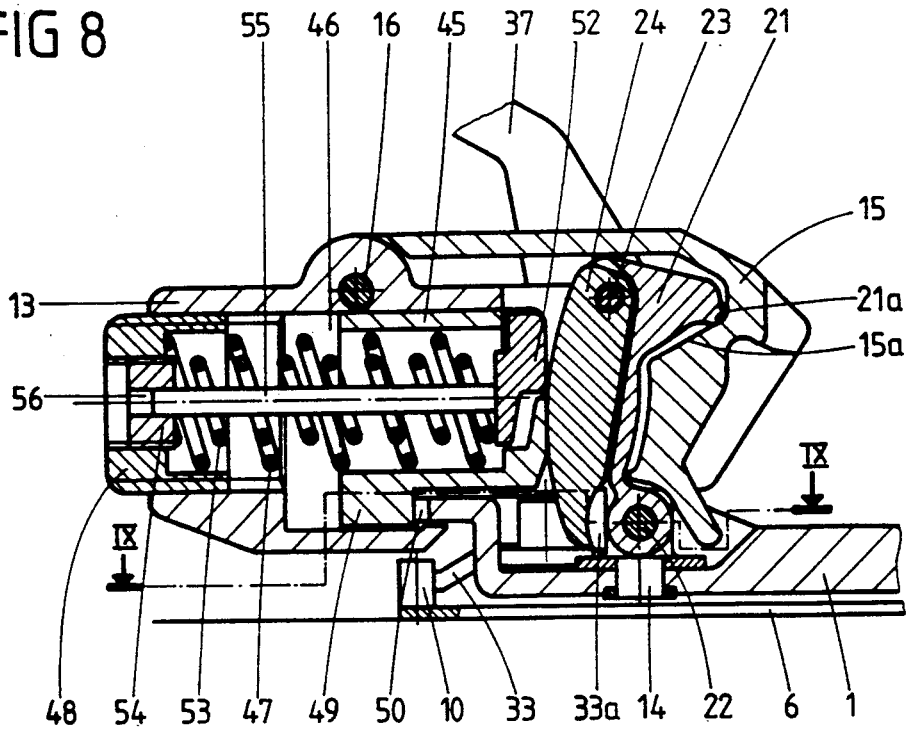
FIG. 8 is a view in longitudinal vertical section along VIII—VIII in FIG. 9, of the rear part of a binding according to a second embodiment.
Figure 9:
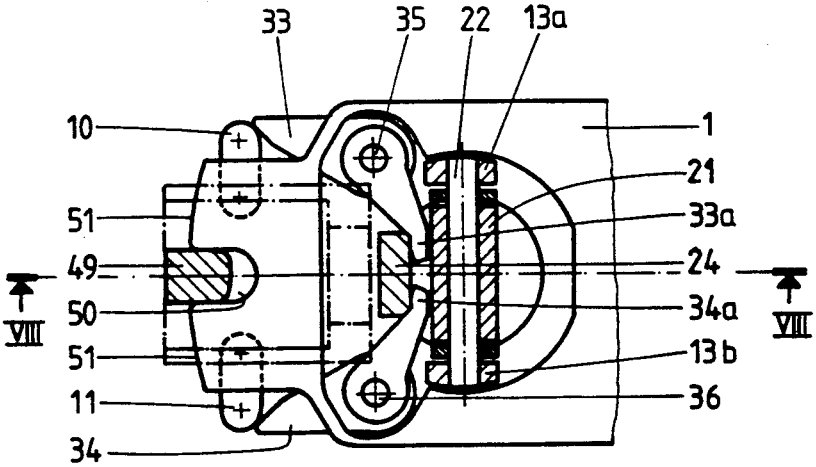
FIG. 9 is a view in cross-section along IX—IX in FIG. 8.

3. The binding as claimed in claim 1, in which the heel unit comprises a grip (15) articulated about a horizontal pin and returned elastically towards the plate by a spring (47, 53) via a lever (21) articulated near the plate about a horizontal pin and provided with a nose (21*a*) bearing against an incline (15*a*) of the grip under the action of a piston (45) pushed by the said spring, wherein the heel unit comprises a second lever (24) articulated at the upper end of the first lever (21) about a pin parallel to the hinge pin of the first lever, this second lever having a curved intermediate part bearing against the said piston, while its lower end bears against the two levers (33, 34) of the return means of the plate (FIG. 8).

4. The binding as claimed in claim 3, wherein the curved part of the second lever (24) of the return means for the grip is a cylindrical surface with the horizontal generatrices, and in the closed position of the binding this curved part bears against the said piston on a generatrix situated between the center of the lever and its lower end such that the leverage resulting from the vertical force exerted on the grip is maximal in the closed position and decreases gradually as the grip is

5. The binding as claimed in claim 1, wherein said grip (15) is articulated about a horizontal pin and returned elastically towards the plate by a spring, via a member capable of rotational and translational movement (21; 57) and provided with a nose (21*a*; 57*a*) bearing against an incline of the grip under the action of the said spring, wherein the heel unit comprises a lever (24; 58) articulated at the upper end of the said member (21; 57) capable of one of a rotational and translational movement, about a horizontal pin, this lever forming a member for transmitting force between the return spring of the plate and the lock (27; 63; 71*b*).

6. The binding as claimed in claim 5, wherein it comprises a return spring (53) acting directly on the said movable member (57) and a return spring (47) acting on the lever (58) articulated on the said movable member.

7. The binding as claimed in claim 5, wherein the lock (27) is articulated near the lower end of the said lever (24), the horizontal pin (23) of the said member capable of rotational movement (21) traversing the lever (24) through a slot (91).

8. The binding as claimed in claim 5, in which the said member capable of rotational and translational movement is a first lever (21), wherein the lever (24) articulated at its upper end is a second lever and has a curved intermediate part bearing against a piston (17) pushed by the said spring (18), while its lower end bears against a member (28) integral with the lock (27).

9. The binding as claimed in claim 8, wherein the curved part of the second lever (24) of the return means for the grip is a cylindrical surface with horizontal generatrices, and wherein said binding has a closed position in which this curved part bears against the said piston on a generatrix situated between the center of the lever and its lower end such that the leverage resulting from the vertical force exerted on the grip is maximum in the closed position and gradually decreases as the grip is raised.

10. The binding as claimed in claim 8, wherein i comprises a first spring (47) acting only on the first lever (21') and a second spring (53) acting only on the second lever (24').

11. The binding as claimed in claim 1, wherein the spring of the lock is used to return the plate and the heel unit to said initial position.

12. The binding as claimed in claim 11, wherein the said common spring is the means for returning the grip towards the plate.

13. The binding as claimed in claim 11, wherein the return means for the plate and the return means for the grip have at least one common spring (47, 53) and the lock (49) is integral with the return means for the grip.

14. The binding as claimed in claim 13, wherein the return means for the plate comprise two levers (33, 34) pivoted on vertical pins, symmetrically on either side of the longitudinal center axis of the plate, one of the ends of these levers bearing against two fixed stops (10, 11) respectively, while the other ends of the levers bear against the lock (49) which applies the force of the spring to the levers, all this having the result that a pivoting of the plate causes the lock to be pushed back by one of the said levers moved by the corresponding fixed stop.

15. The binding as claimed in claim 3, wherein the heel unit comprises two coaxial springs (47, 53), one of the springs (47) interacting with a first piston (45) pushing the lock (49) and the second spring (53) acting on a second piston (52) the first piston (45) being capable of being pushed back without the second piston, the said curved part of the second lever (24) bearing against the first piston (45) in the closed position of the heel unit, and also bearing against the second piston (52) when the grip is raised.

16. The binding as claimed in claim 11, wherein the lock (**27; 63; 71*b***) forms part of the return means for the plate and the heel unit.

17. The binding as claimed in claim 16, wherein the return means for the plate comprise two levers (33, 34) pivoted on vertical pins, symmetrically on either side of the longitudinal center axis of the plate, one of the ends of these levers bearing against said fixed stop means (10, 11) respectively, while the other ends of the levers bear against the lock (27) which applies the force of the spring to the levers, all this having the result that a pivoting of the plate causes the lock to be pushed back by one of the said levers moved by the corresponding fixed stop.

18. The binding as claimed in claim 17, wherein the incline is such that it tends to return the lock into its notch under the influence of its spring (18).

19. The binding as claimed in claim 18, wherein the outer ends of the said incline (31) form a stop (44) for the lock.

20. The binding as claimed in claim 16, wherein the return means for the plate comprise a roller (66; 73) integral with the lock and a fixed incline (64; 74) against which bears the roller.

21. The binding as claimed in claim 20, wherein the grip (15) is returned via a slide (57) on which a spring (53) acts directly, the said lever (58) being articulated at the rear of this slide and integral with the lock (63) and a roller (66).

22. The binding as claimed in claim 21, wherein it comprises a first spring (53) pushing the said slide and a second spring (47), coaxial with the first spring, pressing on the said lever (58).

23. The binding as claimed in claim 20, wherein the said lock (**71*b*) is a tilting lock pivoted on a horizontal pin (72) and bearing against the lower end of a said second lever (24) and return means for the grip, the said roller (73) being pivoted on a pin perpendicular to a pin of a rocker (71**).

* * * * *